United States Patent [19]

Russo

[11] 4,222,568

[45] Sep. 16, 1980

[54] GOLF GAME DEVICE INCLUDING DISTORTABLE PLAYING SURFACE

[76] Inventor: Olerio Russo, 19 Washington Ave., North White Plains, N.Y. 10603

[21] Appl. No.: 958,049

[22] Filed: Nov. 6, 1978

[51] Int. Cl.[3] ..... A63B 67/02; A63B 69/36

[52] U.S. Cl. ..... 273/176 H; 273/201; 273/178 B

[58] Field of Search ..... 273/176 H, 34 B, DIG. 31, 273/113, 176 F, 176 FA, 176 FB, 178 B, 179 C

[56] References Cited

U.S. PATENT DOCUMENTS

| | | | |
|---|---|---|---|
| 3,170,694 | 2/1965 | Dolce | 273/176 H |
| 3,366,388 | 1/1968 | Del Raso | 273/176 H |
| 3,870,301 | 3/1975 | Brisendine | 273/34 B |

*Primary Examiner*—George J. Marlo
*Attorney, Agent, or Firm*—Alfred E. Miller

[57] ABSTRACT

A portable golf practice putting green having a bendable playing floor in which the contours of the practice green may be changed at will by adjustments under the floor or by a knob at the rear of the playing surface connected to one end of an elongated operating shaft. The other end of the shaft is provided with a mechanical rack and pinion for selective bending of the playing floor.

4 Claims, 9 Drawing Figures

GOLF GAME DEVICE INCLUDING DISTORTABLE PLAYING SURFACE

This invention relates to a portable golf practice putting green incorporating a ball return mechanism.

An object of the present invention is to provide a practice putting green which has a partial bendable playing floor whereby the contours of the green may be changed at will to create a variety of putting green shots.

Another object of the present invention is to provide a simplified golf ball return apparatus for the present practice putting green which is foot-actuated and is inexpensive to construct.

A further object of the present invention is to provide individually operated adjusting means for changing the contour or roll of the bendable floor of the practice green. Thus, the "lie" of the practice green may be changed to suit the player's desire.

Another object of the present invention is to provide a portable golf practice green which is reliable effective for the purposes intended.

The above and other features, objects and advantges of the present invention will be fully understood from the following description considered in connection with the accompanying illustrative drawings.

DESCRIPTION OF THE PREFERRED EMBODIMENTS OF THE INVENTION

Figure 1:
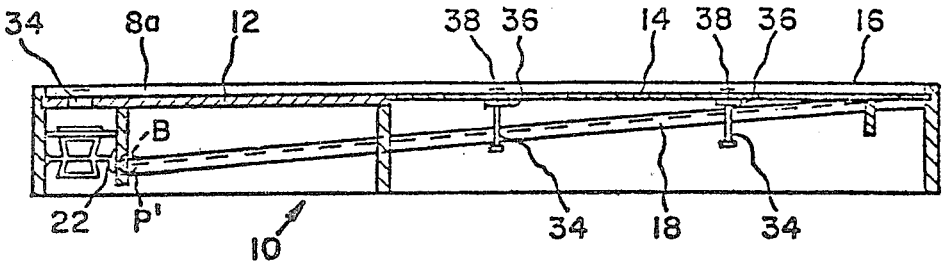
FIG. 1 is a sectional view of the golf practice putting green constructed in accordance with the teachings of my invention.

Referring to the drawings, the present invention comprises a practice golf putting green comprising a rigid, rectangular frame 8 enclosing an enlongated, generally rectangular platform 10 having a reinforced section 12 capable of withstanding the weight of the person standing thereon, and a forward part constituted of a bendable material such as a relatively thin plywood or a plastic sheet, and referred to as bendable floor 14. The player stands in the general area marked with the reference letter G and strikes or putts the golf ball B, also placed in that area, aiming for the hole 16. If the player is successful in putting the ball into the hole 16 the ball returns in the chute 18 by gravity to the position P' where a blocking plate 22 prevents the ball from moving out of the bottom of the chute 18. It should be noted that frame 8 is preferably provided with a top edge bead 8*a* which functions to contain the golf ball on the playing surface of the practice putting green in the event that the ball misses the hole 16.

Figure 3:
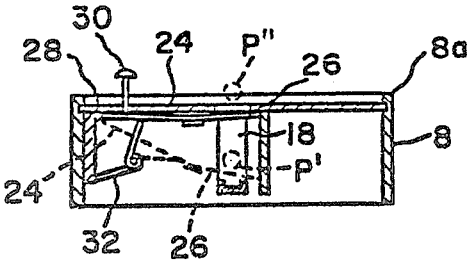
FIG. 3 is an end view thereof, taken from the left hand side of FIG. 2.

The ball elevator arrangement for bringing the ball B from position P' to its position P'' (FIG. 3) constitutes hinged plates 24 and 26 which are pivoted at 28 at the end of hinged plate 24 and section 12 of platform 10. A foot button 30 is secured at one end to hinged plate 24. A spring 32 is secured at one free end to section 12 of platform 10 and at its other free end to hinged plate 24. Thus, in the normal condition, the spring 32 urges the hinged plates 24 and 26 to their full line position as shown in FIG. 3 where the opening 34 in the reinforced section 12 of the platform 10 is closed. However, when the player depresses the foot button 30, for example by the foot, the ball elevator arrangement assumes the position shown in dotted lines in FIG. 3 and the blocking plate 22 clears the open end of the chute 18 to permit the ball B in position P' to roll on the hinged plate 26 to a location for being elevated when the player releases his foot from the foot button 30.

Figure 4:
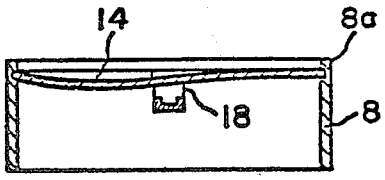
FIG. 4 is a sectional view taken along the lines 4—4 of FIG. 2.
Figure 5:
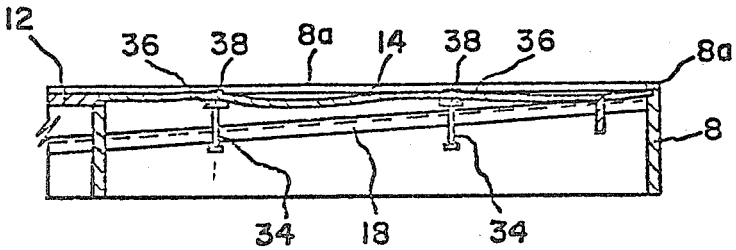
FIG. 5 is a sectional view taken along the lines 5—5 of FIG. 2.
Figure 6:
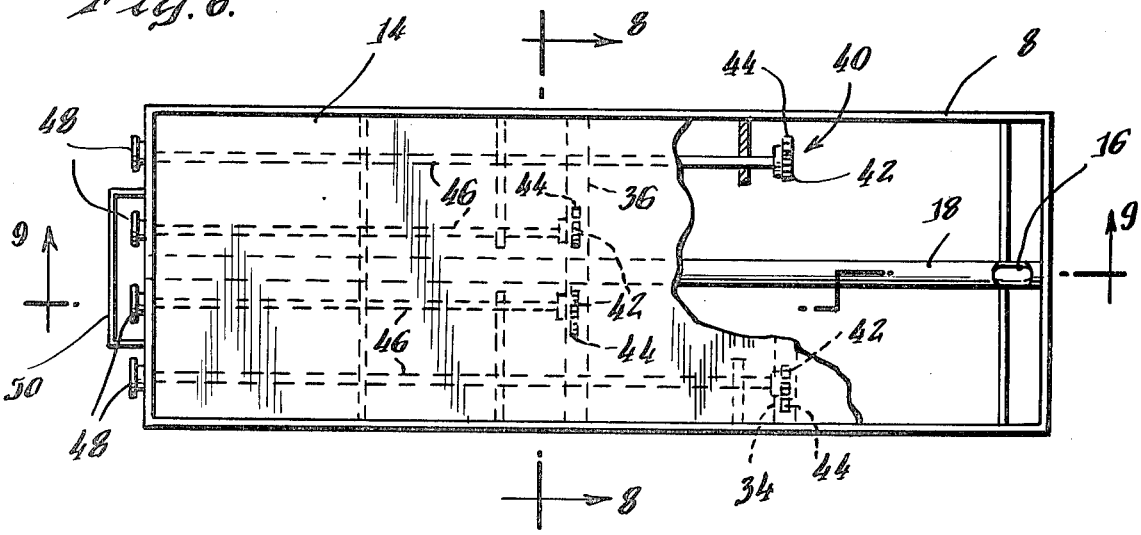
FIG. 6 is a top plan view partly in elevation showing another embodiment of my invention.
Figure 7:
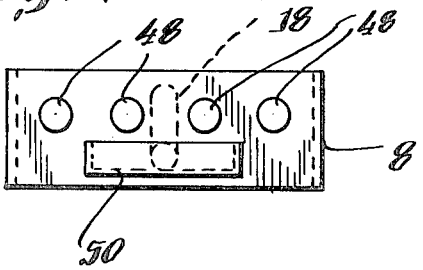
FIG. 7 is a cross-sectional view of FIG. 6, taken along the lines 7—7 thereof.
Figure 8:
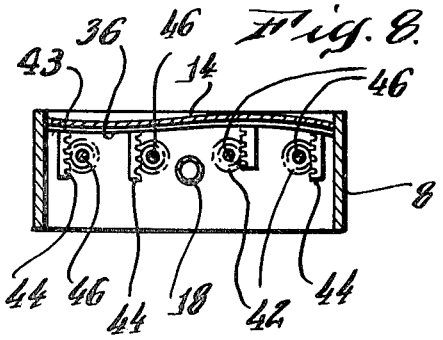
FIG. 8 is another cross-sectional view of FIG. 6, taken along the lines 8—8 thereof.
Figure 9:
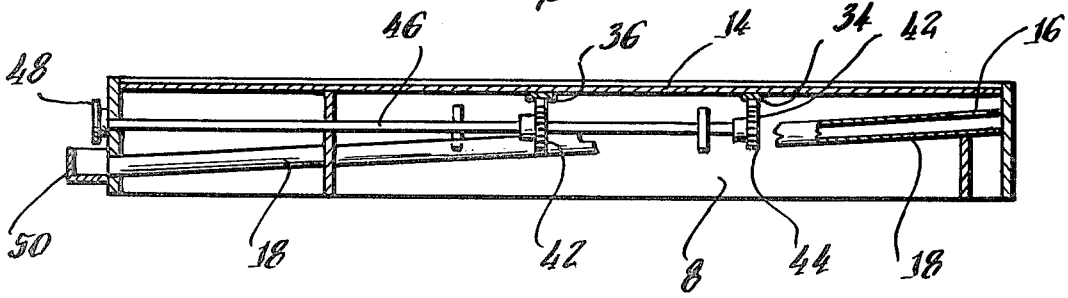
FIG. 9 is a longitudinal section of the invention shown in FIG. 6 and illustrating the details of the device for raising and lowering the bendable floor.

The contour of the bendable floor 14 at the forward part of the practice putting green can be selectively changed by means of bolts 34 in cross members 36. The ends of the bolts 34 terminate in flat support members 38. Bolts 34 may be turned clockwise or counterclockwise in order to lift or lower local areas of the floor to thereby create a selected contour of bendable floor 14. It should be noted that cross members 36 are suitably secured to the frame 8 thereby permitting the bendable floor to be unsupported except by a rigid support at its peripheral edges and to a very small extent by the resting support of the flat support members 38. The changeable contour of the bendable floor 14 is clearly seen in FIGS. 4 and 5 of the drawings, and contour changes in the bendable floor 14 may be selectively made at will in order to change the "lie" of the green. Thus, many different green shots may be made by the player to thereby further improve his putting skill. It should be apparent that a material with a grass-simulated surface may be cemented or otherwise secured to both reinforced section 12 and bendable floor 14 of the platform 10 to further give the playing surface the texture of an actual golf green.

Figure 2:
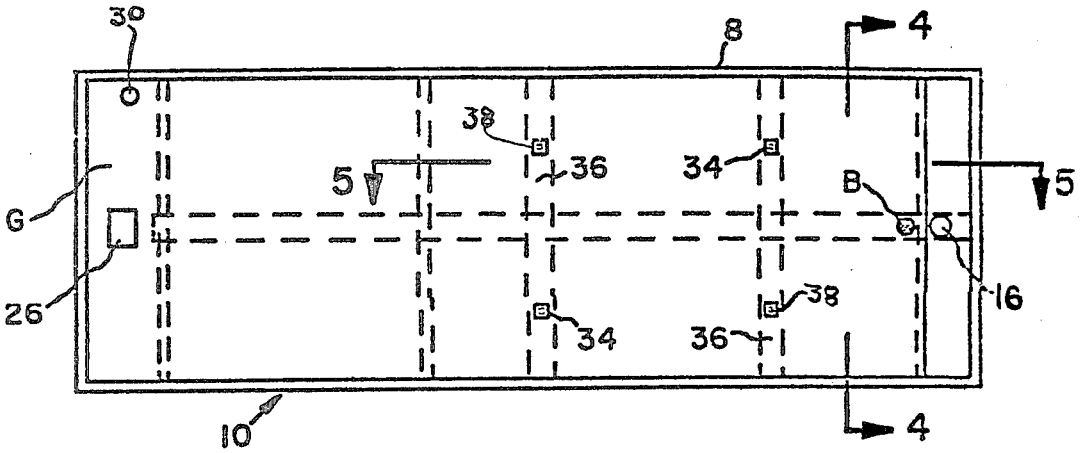
FIG. 2 is a top plan view of said golf practice putting green.

FIGS. 6–9 shown another embodiment of the present invention in which a bendable floor 14 is provided with a rack and pinion gear arrangement referred to generally by the reference numeral 40. In this construction the top perpendicular surface 43 of the rack 42 engages each of the cross members 34 and 36 in a manner similar to the bolts 34 shown in FIGS. 1, 2, and 5, respectively. The pinion worm 44 of each assembly is provided with a long shaft 46 having its free end attached to a knob 48 that is located exterior to the rectangular frame 8. Thus, the location of each of the knobs 48 is at the end of putting green remote from the hole 16. Therefore, by rotating each of the shafts 46 in either a clockwise or counterclockwise direction, the bendable floor 14 can be either raised or lowered selectively, as is particularly seen in FIG. 8. Furthermore, the construction shown in FIGS. 6–9, shows a return chute 18 similar to that shown in FIG. 1, however, this chute extends through the rectangular frame 8 and terminates exterior thereof at a location immediately above a ball-catching pocket 50. It should also be apparent that the construction shown in FIGS. 6–9 has an added advantage over that shown in FIGS. 1–5 in that all controls relating to the changing of the contour of the bendable floor 14 are exterior of the golf practice putting green. In addition, the chute return 18 has a golf ball-catching device that is also exterior of the golf practice putting green. Thus, a player does not have to reach into the internal structure and mechanisms of the device in order to retrieve the golf ball or change the "lie" of the putting green. Moreover, it is within the scope of the invention to substitute other forms of gearing, such as pneumatic or hydraulic means operable by the shaft 46 and which achieves the desired result of elevating or lowering the bendable floor 14 for a desired orientation of the putting green.

While I have shown and described the preferred embodiment of my invention, it will be understood that the latter may be emobodied otherwise than as herein specifically illustrated or described and that in the illustrated embodiment certain changes in the details of construction and in the arrangement of parts may be made without departing from the underlying idea or principle of the invention within the scope of the appended claims.

What is claimed is:

1. A golf practice putting green comprising a platform having a rear reinforced rigid section putting area and a forward bendable floor section, said bendable floor section being provided with a hole therethrough for the reception of a golf ball, and a ball return chute for receiving the ball dropping through said hole, means adjacent to said rear reinforced section for collecting said ball, at least one rigid member located underneath said bendable floor, a rack and pinion arrangement being supported on said rigid member and adapted to engage the unsupported undersurface of said bendable floor for selectively adjusting the contour of said floor, and a shaft operable at the rear reinforced section putting area and connected to said means for adjusting the same.

2. A golf practice putting green as claimed in claim 1 wherein the free end of said shaft is provided with a knob for rotation of said shaft as well as the pinion worm gear.

3. A golf practice green as set forth in claim 1 wherein said bendable floor is a relatively thin plywood.

4. A golf practice green as set forth in claim 1 wherein said bendable floor is a plastic sheet.

* * * * *